United States Patent [19]

Alderman

[11] 4,144,916

[45] Mar. 20, 1979

[54] LIQUID METERING FUNNEL APPARATUS

[76] Inventor: Robert J. Alderman, 812 59th St., NW., Bradenton, Fla. 33505

[21] Appl. No.: 836,558

[22] Filed: Sep. 26, 1977

[51] Int. Cl.[2] ..... B65B 3/04

[52] U.S. Cl. ..... 141/105; 141/297; 366/160

[58] Field of Search ..... 141/105, 297, 9, 100–104, 141/106, 107, 234–248, 199–205, 298, 299, 300, 331–345, 392; 366/160, 162, 181

[56] References Cited

U.S. PATENT DOCUMENTS

| | | | |
|---|---|---|---|
| 2,902,062 | 9/1959 | Von Smekal | 141/105 |
| 3,664,640 | 5/1972 | Morin | 366/160 |

*Primary Examiner*—Houston S. Bell, Jr.

*Attorney, Agent, or Firm*—Jones, Thomas & Askew

[57] ABSTRACT

A funneling device for automatically measuring proportional amounts of two liquids and simultaneously mixing the two liquids. The device includes separate input spouts for each of two liquids, a common output spout, and a device for restrictively metering one liquid into the mainstream flow of the second liquid in amounts proportionate to the amount of second liquid leaving the common output spout.

5 Claims, 5 Drawing Figures

LIQUID METERING FUNNEL APPARATUS

BACKGROUND OF THE INVENTION

The present invention relates most practically to the combining of oil and gasoline for use in two stroke internal combustion engines.

Preparing the fuel for a two stroke engine has always required that one open a can of oil, pour the oil into the tank, pour gas on top and slosh the mixture around in order to achieve at least minimal unformity. Beyond the problem of uniform mixing, the problem has always existed in the preparation of such fuel that unless the fuel tank was completely empty, one never knew exactly how much oil to add to the fractional amount of gasoline required to fill the tank. Too little oil in the mixture would improperly lubricate the engine, while too much oil would cause excessive exhaust smoke and could foul the sparkplugs of the engine.

The problem of proper mixing has been approached by U.S. Pat. No. 2,902,062, which discloses a filling device in which two liquids, such as oil and gas, are mixed prior to the time that they enter the fuel tank. The patented device, however, does not measure proportionate amounts of the two liquids. Rather, the exact amount of oil which is to be mixed with the amount of gas used must be known and measured out prior to the time the oil is placed in the funnelling device. This does not solve the problem of guessing at fractional amounts to be used.

The present invention solves the problem of fractional measurements of the two fluids, especially the oil, by providing within the funneling apparatus a device for determining the amount of gasoline flowing through the apparatus and subsequently releasing oil into the gas stream in amounts proportionate to the amount of gasoline being used. The oil need not be measured out ahead of time, since the amount of oil entering the gas stream is metered in proportion to the amount of gasoline.

The present invention makes possible the fractional filling of a fuel tank without the need for bothersome and inaccurate measurements of the amount of the two liquids being used.

Other objects, features, and advantages of the present invention will become apparent upon reading the following specification, when taken in conjunction with the accompanying drawings.

DETAILED DESCRIPTION OF THE DRAWINGS

Figure 1:
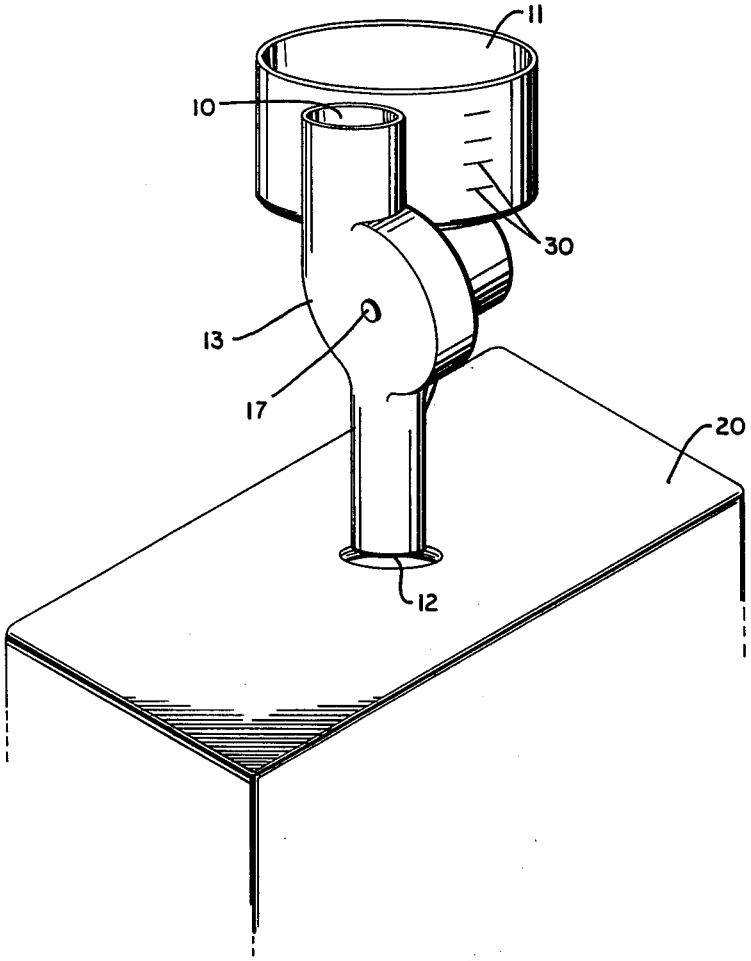
FIG. 1 is a pictorial view of one embodiment of this invention, using a metering wheel arrangement.

FIG. 1 shows one embodiment of the invention having a gas inlet spout 10, an oil reservoir 11, and an output spout 12 common to both the oil and gas. Channeling device 13 connects gas inlet spout 10 and oil reservoir 11 to the common output spout 12. Large paddle wheel 14 (see FIG. 2) is located within the channeling device 13 in such a position that gas entering gas inlet spout 10 must pass over the paddles of large paddle wheel 14 while flowing to the output spout 12.

Figure 3:
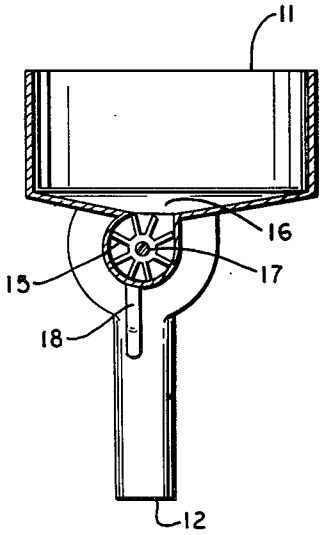
FIG. 3 is a sectioned rear elevational view of the embodiment shown in FIG. 1.

Small paddle wheel 15, shown in FIG. 3, is located at the base of oil reservoir 11 and at a drainage point 16 of the reservoir 11. The two wheels 14 and 15 are connected in such a way that they rotate simultaneously in dependence on one another. In the present embodiment, the two paddle wheels 14 and 15 are interconnected by the shaft 17 which acts as a common axis of rotation for both paddle wheels. Drain spout 18 connects oil reservoir 11 to the channeling device 13 with oil entering the channeling device 13 through drain hole 19.

Figure 2:
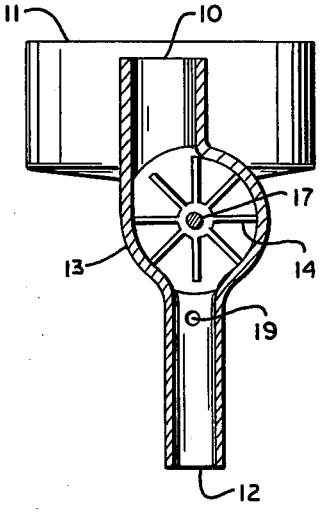
FIG. 2 is a sectioned front elevational view of the embodiment shown in FIG. 1.

The embodiment shown in FIGS. 1, 2 and 3 operates as follows:

Oil is placed into oil reservoir 11, and a flow of gasoline is then injected into the channeling device 13 through gas inlet spout 10. The gasoline may come from the nozzle of a connectional gasoline pump, or may come from another source such as a separate gas can. The gas passes over larger paddle wheel 14 on its way to the common output spout 12. As it flows over the paddle wheel 14, the gas turns the large paddle wheel 14 which in turn simultaneously rotates the smaller paddle wheel 15. Oil at drainage point 16 of the oil reservoir 11 flows into the spaces between paddles of the smaller paddle wheel 15. As this smaller paddle wheel 15 rotates in conjunction with larger paddle wheel 14, the oil caught between the paddles of the smaller paddle wheel is subsequently dumped into drain spout 18 and thus passes through drain hole 19 into the channeling device 13. In this way the gas and oil are mixed in the channeling device 13 and emerge together from output spout 12 into the liquid receptacle 20. The relative diameters of larger paddle wheel 14 and smaller paddle wheel 15 are predetermined and the wheels are so constructed that the smaller paddle wheel 15 meters and dispenses a desired proportionate amount of oil into the drainage spout 18 in response to the amount of gasoline flowing over larger paddle wheel 14. In this way, the resulting mixture is composed of predetermined proportionate amounts of gas and oil.

Figure 4:
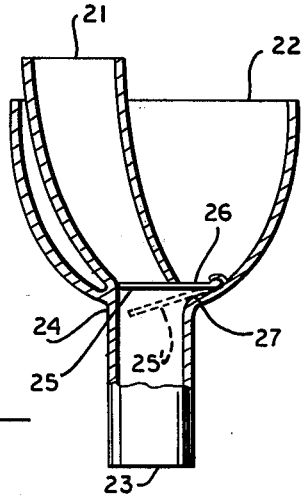
FIG. 4 is a sectioned elevational view of a second embodiment of the invention, using a flap valve for metering.
Figure 5:
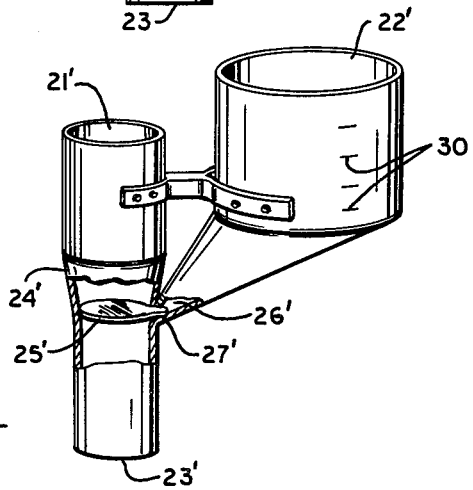
FIG. 5 is a pictorial view of an alternate embodiment of the invention, with cutaway view of a flap valve metering means.

FIGS. 4 and 5 show two different embodiments of the present invention using a flap valve metering device. The embodiment of FIG. 4 shows the oil reservoir 22 encircling the gas inlet spout 21. Channeling device 24 connects the gas inlet spout 21 with an output spout 23 which is common to both the gas and oil. Flap valve 25 is located at the drainage point 26 of the oil reservoir and extends across the channeling device 24 such that gas entering through gas inlet spout 21 must pass over the flap valve 25 while flowing to the common output spout 23. As gas passes over the flap valve 25, the flap valve is moved downward (as shown by the dotted line 25') in proportion to the flowing of gas, thus opening drain hole 27 and allowing oil to flow from the reservoir 22 into the channeling device 24. The gas and oil are thus mixed prior to leaving common output spout 23. The amount of oil released through drain hole 27 is proportionate to the amount of gas passing over flap valve 25. The flap valve 25 is so constructed that a predetermined proportionate relationship of gas to oil is achieved in the resulting mixture.

FIG. 5 shows an alternate embodiment of the device in FIG. 4 in which the gas inlet spout 21' and oil reservoir 22' are set side by side. The operation of the device in FIG. 5 is similar to that explained previously for the device in FIG. 4.

The oil reservoir of the present metering funnel may be made of clear plastic if desired, and can be provided with graduations 30 which indicate the amount of oil required to mix with given amounts of gasoline at a given mix ratio. The funnels may also be equipped to manually discharge an extra measure of oil into the common output spout, which may be necessary for proper lubrication of engines during their break-in period.

It will be understood that the foregoing relates only to a disclosed embodiment of the present invention and that numerous changes and modifications may be made therein within the scope of the invention as defined in the following claim.

I claim:

1. Apparatus for mixing liquids in predetermined proportions comprising a pair of chambers positioned in side by side relationship, an inlet spout communicating with one side of said first chamber and an outlet spout communicating with the other side of said first chamber, an inlet opening on one side of said second chamber and a drain spout communicating at one of its ends with the other side of said second chamber, said drain spout communicating at the other of its ends with said outlet spout, a flow responsive member in said first chamber and rotatable at an angular velocity corresponding to the volume of liquid moving through said first chamber, a metering member in said second chamber and rotatable in unison with the rotation of said first flow responsive member, a reservoir defining an outlet opening in communication with the inlet opening of said second chamber, whereby the movement of liquid through said first chamber rotates said flow responsive member and said metering member and meters the second liquid from said reservoir through said second chamber and mixes the first and second liquids in a predetermined ratio.

2. Funnelling apparatus for metering desired amounts of one liquid for mixing with a proportionate amount of another liquid and for mixing the two liquids, such as gasoline and oil, said apparatus comprising:

a gas inlet spout for receiving an amount of gas from a gas supply;

an oil reservoir;

an output spout common to both said gas inlet spout and said oil reservoir for discharging the gas and oil;

metering means positioned between said gas inlet spout and oil reservoir on one side and said output spout on the other side for metering an amount of oil from said oil reservoir in proportion to the amount of gas entering said gas inlet spout, said metering means comprising a first wheel means over which the gas passes and which is rotated by the gas as the gas flows from said gas inlet spout to said output spout, a second wheel means of a size predetermined relative to said first wheel means operably connected to said first wheel means and rotatable in response to the rotation of said first wheel means, said second wheel means being positioned to receive oil from said oil reservoir; and drainage means for draining said metered amount of oil from said second wheel means of said metering means into the mainstream flow of gas, whereby said metered amount of oil is withdrawn from said oil reservoir by said metering device in response to the flow of gas and is introduced into the mainstream flow of the gas and thus into said output spout.

3. Apparatus for metering desired amounts of one liquid for mixing with a proportionate amount of another liquid and for mixing the two liquids for introduction to a liquid receptacle, said apparatus comprising:

channeling means defining side by side first and second chambers, an inlet spout in communication with one side of said first chamber and an outlet spout in communication with the other side of said first chamber for directing a first liquid through said first chamber, an inlet opening in communication with one side of said second chamber and a drain spout in communication at one of its ends with the other side of said second chamber for directing a second liquid through said second chamber and said drain spout in communication at the other of its ends with said outlet spout;

reservoir means for containing said second liquid in anticipation of use, said reservoir defining a drain in communication with said inlet opening of said second chamber;

metering means in said channeling means, said metering means comprising an axle extending between said first and second chambers, a first paddle wheel in said first chamber mounted on and rotatable with said axle, said first paddle wheel being positioned between the inlet spout and the outlet spout of said first chamber and arranged to rotate in response to the flow of liquid moving through said first chamber, a second paddle wheel in said second chamber mounted on and rotatable with said axle, said second paddle wheel being positioned between the inlet opening and the drain spout of said second chamber and rotatable in unison with the rotation of said first paddle wheel, whereby the rotation of said first and second paddle wheels in response to the flow of the first liquid through said first chamber meters the second liquid from the reservoir through the second chamber and combines the liquids in the outlet spout.

4. Funnelling apparatus for metering desired amounts of one liquid for mixing with a proportionate amount of another liquid and for mixing the two liquids, such as gasoline and oil, said apparatus comprising:

a gas inlet spout for receiving an amount of gas from a gas supply;

an oil reservoir;

an output spout common to both said gas inlet spout and said oil reservoir for discharging the gas and oil;

metering means positioned between said gas inlet spout and oil reservoir on one side and said output spout on the other side for metering an amount of oil from said oil reservoir in proportion to the amount of gas entering said gas inlet, said metering means comprising an opening of predetermined size in said oil reservoir, said opening emptying into the mainstream flow of gas as the gas flows from said gas inlet spout to said output spout, and a flap valve covering said opening with a portion of said flap valve extending into said mainstream flow of gas to be impinged by the flow of said gas, so that the flow of the gas over said flap valve opens said flap valve in proportion to the volume of gas flowing over said flap valve to meter said oil into the mainstream flow of gas and thus into said output spout.

5. Apparatus of claim 4 and further including means for manually allowing said oil to flow from said oil reservoir regardless of the presence of said gas.

* * * * *